US005229030A

United States Patent [19]

Clubley et al.

[11] Patent Number: 5,229,030

[45] Date of Patent: Jul. 20, 1993

[54] CORROSION INHIBITION

[75] Inventors: Brian G. Clubley, Wilmslow; Jan Rideout, Bolton, both of England

[73] Assignee: FMC Corporation, Philadelphia, Pa.

[21] Appl. No.: 788,689

[22] Filed: Nov. 6, 1991

[30] Foreign Application Priority Data

Nov. 10, 1990 [GB] United Kingdom ..... 9024470

[51] Int. Cl.[5] ..... C23F 11/167

[52] U.S. Cl. ..... 252/389.23; 252/180; 422/18; 210/699; 210/700

[58] Field of Search ..... 252/180, 389.23, 389.22; 422/18; 210/699, 700

[56] References Cited

U.S. PATENT DOCUMENTS

| | | | |
|---|---|---|---|
| 2,957,931 | 10/1960 | Hamilton et al. | 252/389.21 X |
| 4,029,577 | 6/1977 | Godlewski et al. | 568/566 X |
| 4,042,324 | 8/1977 | Auel et al. | 210/15 |
| 4,046,707 | 9/1977 | Smith et al. | 252/180 |
| 4,052,160 | 10/1977 | Cook et al. | 422/15 |
| 4,105,551 | 8/1979 | Smith et al. | 210/700 |
| 4,127,483 | 11/1978 | Smith et al. | 252/180 |
| 4,159,946 | 7/1979 | Smith et al. | 210/699 |
| 4,208,344 | 6/1980 | Dingwell | 210/699 |
| 4,239,648 | 12/1980 | Marshall et al. | 252/389.22 |
| 4,374,733 | 2/1983 | Snyder et al. | 210/701 |
| 4,563,284 | 1/1986 | Amjad | 252/180 |
| 4,681,686 | 7/1987 | Richardson et al. | 210/699 |
| 5,073,299 | 12/1991 | Cook | 252/389.23 |
| 5,160,630 | 11/1992 | Clubley et al. | 252/181 |

FOREIGN PATENT DOCUMENTS

| | | |
|---|---|---|
| 0009080 | 4/1980 | European Pat. Off. . |
| 0152660 | 8/1985 | European Pat. Off. . |
| 0283191 | 9/1988 | European Pat. Off. . |
| 0360746 | 3/1990 | European Pat. Off. . |
| 3044214A1 | 6/1982 | Fed. Rep. of Germany . |
| 2274565 | 1/1976 | France . |
| 2318943 | 2/1977 | France . |
| 1474362 | 5/1977 | United Kingdom . |
| 1539974 | 2/1979 | United Kingdom . |

*Primary Examiner*—Robert L. Stoll
*Assistant Examiner*—Valerie Fee
*Attorney, Agent, or Firm*—Patrick C. Baker; Robert L. Andersen

[57] ABSTRACT

A method of inhibiting corrosion of metal surfaces in contact with an aqueous system, comprising contacting the metal surfaces with a telomer compound having the formula I:

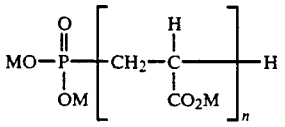

I in which M is hydrogen or an alkali or alkaline earth metal ion, an ammonium ion or a quaternised amine radical; and n is an average integer ranging from 1 to 60.

8 Claims, No Drawings

CORROSION INHIBITION

The present invention relates to a method of inhibiting corrosion of metal surfaces in contact with an aqueous system.

In U.S. Pat. No.: 4046707 there is described a method of inhibiting the precipitation of scale-forming salts of calcium, magnesium, barium and strontium from aqueous systems. The method comprises adding to the aqueous system a minor proportion of a product comprising a telomeric compound of formula:

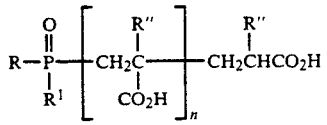

and salts thereof, in which R″ is hydrogen, methyl or ethyl; R is hydrogen, $C_1$–$C_{18}$ alkyl, $C_5$–$C_{12}$ cycloalkyl, aryl, aralkyl, a residue of formula

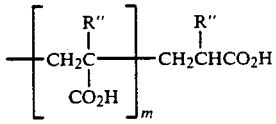

in which R″ has its previous significance and the sum of m and n is an integer of at most 100, or R is a residue -OX in which X is hydrogen or $C_1$–$C_4$ alkyl; and $R^1$ is a residue - OX in which X has its previous significance.

There is no suggestion in U.S. Pat. No.: 4046707 that any of the disclosed telomers could have any inherent corrosion—inhibiting properties. In fact, many of the disclosed telomers exhibit no or minimal corrosion—inhibiting properties.

In U.S. Pat. No.: 4239648 there are described compositions, useful for inhibiting the corrosion of ferrous metals, in contact with aqueous systems, comprising a) the telomeric compounds used in the method of U.S. Pat. No. 4046707 and b) one or more compounds selected from i) a zinc salt, ii) a polyphosphate, iii) a silicate and/or iv) a molybdate.

The telomers preferred for use in the compositions of U.S. Pat. No.: 4239648 are those having the formula

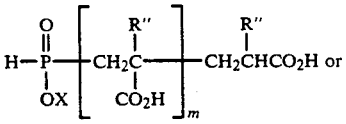

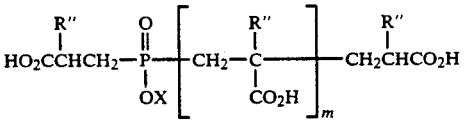

in which R″, X and m have their previous significance.

These preferred telomers, when used along at a level of 100 ppm in the Aerated Solution Bottle Test, give a percentage level of corrosion inhibition of at most, only 43%. Only when those preferred telomers were used in conjunction with a zinc, polyphosphate silicate or molybdate coadditive, did the combinations so obtained attain satisfactory corrosion inhibition levels of 80% or more.

We have now found surprisingly, that by selecting certain telomers, distinct from those preferred in 4239648, out of the broad range of telomers disclosed in U.S. Pat. No. 4046707, the selected telomers have inherently high corrosion inhibiting properties, without the need for co-additives to boost their corrosion inhibiting effect.

Accordingly, the present invention provides a method of inhibiting corrosion of metal surfaces in contact with an aqueous system by contacting the metal surfaces with a telomer compound having the formula I:

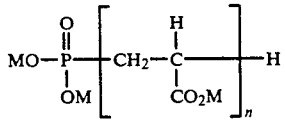

I in which M is hydrogen or an alkali or alkaline earth metal ion, an ammonium ion or a quaternised amine radical; and n is an average integer ranging from 1 to 60, preferably from 4 to 30.

Alkali metal cations M are, principally, lithium, sodium and potassium ions; alkaline earth metal atoms are, e.g., calcium, magnesium, barium or strontium; ammonium ions include, e.g. trimethylammonium, triethylammonium, bis(2-hydroxyethyl) ammonium, tris(2-hydroxyethyl) ammonium and bis(2-hydroxyethyl)-2-(hydroxy-3-p-nonylphenoxypropyl) ammonium ions; and quaternised amine radicals include those having the formula $N\oplus(R_aR_bR_cR_d)_4\,An\ominus$ in which $R_a$, $R_b$, $R_c$ and $R_d$ are the same or different, and each is $C_1$–$C_6$ alkyl, especially methyl or ethyl, or each is 2-hydroxyethyl, or one of $R_a$, $R_b$, $R_c$ and $R_d$ is benzyl, and the other three of $R_a$, $R_b$ $R_c$ and $R_d$ are $C_1$–$C_6$ alkyl, especially methyl or ethyl, and $An\ominus$ is a halide ion, especially chloride or bromide, hydroxyl or sulphate.

The compounds of formula I are known compounds, having been broadly described in U.S. Pat. No. 2957931 and, of course, in U.S. Pat. No. 4046707.

The compounds of formula I may be produced by reacting the appropriate molar ratio of acrylic acid, or a $C_1$–$C_6$ alkyl ester thereof, depending upon the desired value of n, with one mole of a di($D_1$–$C_4$ alkyl)phosphite or diarylphosphite, in particular diethylphosphite.

The reaction may be conveniently conducted in the presence of a polymerization initiator such as bisazoisobutyronitrile; organic peroxides such as benzoyl peroxide, methylethylketone peroxide, di-tertiarybutyl peroxide and mono-butyl hydroperoxide; or oxidizing agents such as hydrogen peroxide, sodium perborate or sodium persulphate.

At completion of the reaction between diethyl phosphite and the acrylic monomer, the crude reaction mixture may be purified, if desired, by conventional techniques, for example, any excess diethyl phosphite reactant may be removed by distillation of the reaction mixture. Moreover, any ester groupings on the acrylic moieties in the compounds of formula I may be converted into carboxyl functions by, e.g., acid hydrolysis. After, such acid hydrolysis, the hydrolyzed product may be evaporated to dryness, to provide solid material of formula I.

Salts of the compound of formula I in which some or all of the acidic hydrogens M in the compounds of formula I have been replaced by alkali metal-ammonium - or quaternised amine cations, may be prepared by mixing an aqueous or alcoholic solution containing the requisite base, in an amount which may be more than, equal to or less than the stoichiometric requirement for full replacement of the acidic hydrogens. The solvent for the base may then be removed, e.g. by evaporation.

Many of the aqueous systems to be treated according to the method of the present invention are sufficiently basic, that the system itself is adequate to effect neutralization, so that when adding the acidic form of the compound of formula I, it is converted in situ into an alkali metal version.

The amount of the compound of formula I, or salt thereof, used in the method according to the present invention may range e.g. from 0.1 to 50,000 ppm, preferably from 1 to 500 ppm, based on the weight of the aqueous system.

The aqueous system which is treated according to the method of the present invention may be a totally aqueous or a partly aqueous medium.

Aqueous systems which may be effectively treated according to the present invention include e.g. cooling water systems, steam generating systems, sea-water evaporators, reverse osmosis equipment, bottle washing plants, paper manufacturing equipment, sugar evaporator equipment, soil irrigation systems, hydrostatic cookers, gas scrubbing systems, closed circuit heating systems, aqueous - based refrigeration systems, down-well systems, aqueous machining fluid formations (e.g. for use in boring, milling, reaming, broaching, drawing, turning, cutting, sewing, grinding, and in thread-cutting operations, or in non-cutting shaping, spinning, drawing or rolling operations), aqueous scouring systems, aqueous glycol anti-freeze systems, water/glycol hydraulic fluids; and aqueous - based polymer surface coating systems.

The compounds of formula I may be used in the method of the present invention either along or in conjunction with other materials known to be useful in water treatment.

In the treatment of systems which are completely aqueous, e.g. cooling water systems, steam-generating systems, sea water evaporator systems, hydrostatic cookers and closed circuit heating systems, examples of further water treatment additives include one or more of further corrosion inhibitors; metal deactivators; further scale inhibitors/dispersing agents; threshold agents; precipitating agents; oxygen scavengers; sequestering agents; antifoaming agents; and biocides.

Further corrosion inhibitors which may be used include water-soluble zinc salts; phosphates; polyphosphates; phosphonic acids or their salts, e.g. hydroxyethyl diphosphonic acid (HEDP), nitrilotris methylene phosphonic acid, methylamino dimethylene phosphonocarboyxlic acids and their salts (e.g. those described in DE-OS 2632774), hydroxyphosphonoacetic acid, 2-phosphonobutane-1,2,4-tricarboyxlic acid and those described in GB-PS 1572406; nitrates e.g. sodium nitrate; nitrites e.g. sodium nitrite; tungstates and molybdates e.g. sodium tungstate or molybdate; silicates e.g. sodium silicate; N-acylsarcosines; N-acylimino diacetic acids; ethanolamines; fatty amines; and polycarboxylic acids, e.g. polymaleic acid and polyacrylic acid (and their respective alkali metal salts), copolymers of maleic anhydride e.g. with sulphonated styrene, copolymers of acrylic acid e.g. with hydroxyalkylated acrylic acid, and substituted derivatives of polymaleic and polyacrylic acids and their copolymers.

Metal deactivators especially for copper, include benzotriazole, bis-benzotriazole or copper - deactivating derivatives of benzotriazole or tolutriazole, or their Mannich base derivatives, or mercaptobenzotriazole.

Scale inhibitors/dispersing agents include polymerized acrylic acid (or its salts), phosphino-polycarboxylic acids (e.g. those described in GB-PS 1458235), the cotelomers described in EP-PS 0150706, hydrolyzed polyacrylonitrile, polymerized methacrylic acid and its salts, polyacrylamide and copolymers of acrylamide with acrylic and methacrylic acids, lignin sulphonic acid and its salts, tannin naphthalene sulphonic acid/formaldehyde condensation products, starch and its derivatives, cellulose, acrylic acid/lower alkyl hydroxy-acrylate copolymers (e.g. those described in U.S. Pat. No. 4029577) styrene/maleic anhydride copolymers and sulphonated styrene homopolymers (e.g. those described in U.S. Pat. No. 4374733, and combinations of these).

Specific threshold agents, include 2-phosphonobutane-1,2,4-tri-carboxylic acid, HEDP, hydrolyzed polymaleic anhydride and its salts, alkyl phosphonic acids, hydroxyphosphonoacetic acid, 1-aminoalkyl-1,1-diphosphonic acids and their salts, and alkali metal polyphosphates.

It will be clear from the above lists that certain additive compounds, e.g. phosphonocarboxylic acids, function both as scale inhibitors and as corrosion inhibitors.

Precipitating agent co-additives which may be used are alkali metal orthophosphates or carbonates; oxygen scavengers include alkali metal sulphites and hydrazines; sequestering agents are nitrilotriacetic acid and its salts; antifoaming agents are silicones, e.g. polydimethylsiloxanes, distearyl sebacimide, distearyl adipamide, and related products derived from ethylene oxide and/or propylene oxide condensations, in addition to fatty alcohols such as capryl alcohol and its ethylene oxide condensates. Biocides which may be used are, e.g. amines, quaternary ammonium compounds, m-chlorophenols, sulphur-containing compounds such as sulphones, methylene bis thiocyanates and carbonates, isothiazolines, brominated propionamides, triazines, phosphonium compounds, chlorine and chlorine-release agents, bromine and bromine release agents, and organometallic compounds such as tributyl tin oxide.

If the system to be according to the invention is not completely aqueous e.g. an aqueous machining fluid formulation, it may be e.g. a water dilutable cutting or grinding fluid.

The aqueous machining fluid formulations of the invention may be e.g. metal working formulations. By "metal working" we mean "reaming, broaching, drawing, spinning, cutting, grinding, boring, milling, turning, sawing, non-cutting shaping or rolling". Examples of water-dilutable cutting or grinding fluids into which the corrosion inhibiting compound of formula I may be incorporated include:

a) Aqueous concentrates of one or more corrosion inhibitors, and optionally one or more anti-wear additives, used at dilutions of 1:50 to 1:100, which are usually employed as grinding fluids;

b) Polyglycols containing biocides, corrosion inhibitors and anti-wear additives which are used at dilutions of 1:20 to 1:40 for cutting operations and 1:60 to 1:80 for grinding;

c) Semi-synthetic cutting fluids similar to b) but containing in addition 10 to 25% oil with sufficient emulsifier to render the water diluted product translucent;

d) An emulsifiable mineral oil concentrate containing, for example, emulsifiers, corrosion inhibitors, extreme pressure/anti-wear additives, biocides, antifoaming agents, coupling agents etc; they are generally diluted from 1:10 to 1:50 with water to a white opaque emulsion;

e) A product similar to d) containing less oil and more emulsifier which, on dilution to the range 1:50 to 1:100, gives a translucent emulsion for cutting or grinding operations.

Mixtures of sodium nitrite and triethanolamine have been used to inhibit corrosion in metal working but, because of related toxicity problems, due e.g. to the danger of forming N-nitrosamines, and because of legal regulations in some countries relating to effluents, alternatives to the use of sodium nitrite are being sought.

For those partly-aqueous systems in which the aqueous system component is an aqueous machining fluid formulation the compound of formula I may be used singly, or in admixture with other additives e.g. known further corrosion inhibitors and/or extreme pressure additives.

Examples of other corrosion inhibitors which may be used in these aqueous systems, in addition to the compound of formula I, include the following groups:

a) Organic acids, their esters or ammonium, amine, alkanolamine and metal salts, for example, benzoic acid, p-tert-butyl benzoic acid, disodium sebacate, triethanolamine laurate, iso-nonanoic acid, triethanolamine salt of(p-toluene sulphonamido caproic acid), sodium N-lauroyl sarcosinate or nonyl phenoxy acetic acid;

b) Nitrogen containing materials such as the following types: fatty acid alkanolamides; imidazolines, for example, 1-hydroxyethyl-2-oleyl-imidazolines; oxazolines; triazoles, for example, benzotriazoles, triethanolamines; fatty amines; and inorganic salts, for example sodium nitrate;

c) Phosphorus containing materials such as the following types: amine phosphates, phosphonic acids or inorganic salts, for example, sodium dihydrogen phosphate or zinc phosphate;

d) Sulphur containing compounds such as the following types: sodium, calcium or barium petroleum sulphonates, or heterocyclics, for example, sodium mercaptobenzothiazole.

Nitrogen containing materials, particularly triethanolamine, are preferred.

Examples of extreme pressure additives which may be present in the systems of the present invention include sulphur and/or phosphorus and/or halogen containing materials, for instance, sulphurised sperm oil, sulphurised fats, tritolyl phosphate, chlorinated paraffins or ethoxylated phosphate esters.

When triethanolamine is present in the aqueous systems treated according to the present invention, it is preferably present in an amount such that the ratio of compound of formula I to triethanolamine is from 2:1 to 1:20.

When triethanolamine is present in the aqueous systems treated according to the present invention, it is preferably present in an amount such that the ratio of compound of formula I to triethanolamine is from 2:1 to 1:20.

The partly-aqueous systems treated by the method of the present invention may also be aqueous surface-coating compositions e.g. primer emulsion paints and aqueous powder coatings for metallic substrates.

The aqueous surface-coating composition may be e.g. a paint such as styrene-acrylic copolymer emulsion paint, a resin, latex, or other aqueous based polymer surface-coating systems.

Sodium nitrite and sodium benzoate have been used to inhibit flash rusting of aqueous based primer paints but, because of related toxicity problems and problems of emulsion stability at the high ionic concentrations used, industry is moving away from sodium nitrite and sodium benzoate.

In aqueous surface-coating compositions treated according to the invention the compound of formula I may be used singly, or in admixture with other additives e.g. known corrosion inhibitors, biocides, emulsifiers and/or pigments.

The further known inhibitors which may be used are e.g. those of classes a), b), c) and d) hereinbefore defined.

Example of biocides which may be used in these aqueous systems, in addition to the compound of formula I, include the following:

Phenols and alkyl- and halogenated phenols, for example pentachlorophenol, o-phenyl phenol, o-phenoxyphenol and chlorinated o-phenoxyphenol, and salicylanilides, diamines, triazines and organometallic compounds such as organomercury compounds and organotin compounds.

Examples of pigments which may be used in these aqueous systems, in addition to the compound of formula I, include titanium dioxide, zinc chromate, iron oxide and organic pigments such as the phthalocyanines.

The following Examples further illustrate the present invention. Examples A, B, C and D relate to the preparation of compounds of formula I for use in the method of the present invention.

EXAMPLE A 100 g of ethyl acrylate and 15 g of di-tert-butylperoxide are added separately, dropwise, to 138 g of diethyl phosphite, over 4 hours, at 140° C. This temperature is maintained for a further 2 hours, after the additions are complete. Unreacted diethyl phosphite is removed by distillation under reduced pressure, and the residue is suspended in 400 g of 18% w/w hydrochloric acid, and the suspension so obtained is heated, under reflux conditions, for 48 hours.

The resulting solution is evaporated to dryness, under reduced pressure, to give 68 g of product (94% of the theoretical yield based on acrylic acid).

The product obtained has an $M_n = 644$ and $M_w = 941$, giving a ratio $M_w/M_n = 1.46$. Microanalysis of the product gives 8.15% P; corresponding to an average value of integer n =4.

EXAMPLE B

Using the procedure set out in Example A, 160 g of ethyl acrylate and 15 g of di-tert butylperoxide are added separately, dropwise, to 55.2 g of diethylphosphite to give 124 g (108% of the theoretical yield based on acrylic acid) of a product having $M_n = 669$ and $M_w = 1019$, giving a ratio $M_w/M_n$ of 1.52. Microanalysis of the product gives: 4.7% P; corresponding to an average value of integer n = 8.

EXAMPLE C

Using the procedure set out in Example A, 88.9 g of ethyl acrylate and 7.3 g of di-tert butyl peroxide are added separately, dropwise, to 15.5 g of diethyl phosphite to give 65 g (103% of the theoretical yield based on acrylic acid) of a product having $M_n = 732$ and $M_w = 2224$ giving a ratio $M_w/M_n$ of 3.04. Microanalysis of the product gives: 315% P; corresponding to an average value of integer n = 12.

EXAMPLE D

Using the procedure described in Example A, 92.3 g of ethyl acrylate and 7.2 g of di-tert butyl peroxide are added separately, dropwise, to 10.6 g of diethyl phosphite to give 71 g of product (107% of theoretical yield based on acrylic acid) having $M_n = 790$ and $M_w = 2837$, giving a ratio $M_w/M_n = 3.59$. Microanalysis of the product gives: 2.1% P; corresponding to an average value of integer n of 20.

EXAMPLE E

Using the procedure set out in Example A, 43 g of methyl acrylate and 7.5 g of di-tert butyl peroxide are added separately, dropwise, to 55 g of dimethyl phosphite to give 40 g (111% of the theoretical yield based on acrylic acid) having $M_n = 705$ and $M_w = 1102$, giving a ratio $M_w/M_n = 1.56$. Microanalysis of the product gives 7.1% P; corresponding to an average value of integer n = 5.

EXAMPLES 1 to 4

The corrosion inhibitor activities of the products of Examples A, B, C and E are evaluated in the Rotating Coupon Test using the following standard corrosive waters.

In the following, PH denotes permanent hardness, PA denotes permanent alkalinity, TA denotes temporary alkalinity and TH denotes total hardness.

| | 150 Ca | 300 Ca |
|---|---|---|
| PH | 8.5 | 8.3 |
| PA | 0 | 0 |
| TA | 350 | 300 |
| TH | 225 | 450 |
| $Ca^{2+}$ (ppm) | 150 | 300 |
| $Mg^{2+}$ (ppm) | 75 | 150 |
| $Cl^-$ (ppm) | 200 | 218 |
| $SO_4^{2-}$ (ppm) | 200 | 38 |

In a one liter reservoir of one of the test waters, two pre-cleaned and pre-weighed mild steel coupons are rotated at a coupon velocity of 61 cms per second. The test is conducted over 48 hours in oxygenated water at 40° C. using 30 ppm of the appropriate corrosion inhibitor under test.

The coupons are removed, scrubbed without pumice, immersed for one minute in hydrochloric acid inhibited with 1% by weight of hexamine, and then rinsed, dried and reweighed. A certain loss in weight will have occurred. A blank test, i.e. immersion of mild steel coupons in the test water in the absence of any test corrosion inhibitor is carried out in each series of tests. The corrosion rates are calculated in milligrams of weight loss-square decimeter/day (m.d.d.).

The results are set out in the Table:

TABLE

| Example | Inhibitor | Inhibitor Concentration (ppm) | Corrosion Rate (m.d.d.) in test water 150 Ca | 300 Ca |
|---|---|---|---|---|
| — | None | | 130.2 | — |
| 1 | Product of Ex. A | 30 | 22.1 | 40.7 |
| 2 | Product of Ex. B | 30 | 31 | 19 |
| 3 | Product of Ex. C | 30 | 78 | 19 |
| 4 | Product of Ex. E | 30 | 38 | 35 |

Claims:

1. A method of inhibiting corrosion of metal surfaces in contact with an aqueous system, comprising contacting the metal surfaces with a telomer compound having the formula I:

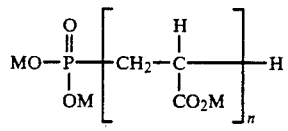

I in which M is hydrogen or an alkali or alkaline earth metal ion, an ammonium ion or a quaternised amine radical; and n is an average integer ranging from 3 to 40.

2. A method according to claim 1 in which the amount of the telomer of formula I used, or salt thereof, ranges from 0.1 to 50,000 ppm, based on the weight of the aqueous system.

3. A method according to claim 2 in which the amount of the telomer of formula I used, or salt thereof, ranges from 1 to 500 ppm, based on the weight of the aqueous system.

4. A method according to claim 1 in which the aqueous system is that comprised in a cooling water system, a steam generating system, a sea water evaporator, reverse osmosis equipment, a bottle washing plant, paper manufacturing equipment, sugar evaporator equipment, soil irrigation systems, hydrostatic cookers, gas scrubbing systems, closed circuit heating systems, aqueous - based refrigeration systems, down-well systems, or aqueous machining fluid formulations, aqueous scouring systems, aqueous glycol antifreeze systems, water/glycol hydraulic fluids or aqueous - based polymer surface coating systems.

5. A method according to claim 1 in which the compound of formula I is used in conjunction with one or more further corrosion inhibitors; metal deactivators; scale inhibitors/dispersing agents; threshold agents; precipitating agents; oxygen scavengers; sequestering agents; anti-foaming agents; and biocides.

6. A method according to claim 1 in which the aqueous system is an aqueous machining fluid formulation.

7. A method according to claim 6 in which the aqueous machining fluid formulation is a water-dilutable cutting or grinding fluid.

8. A method according to claim 6 in which the compound of formula I is used singly or in admixture with a further corrosion inhibitor and/or an extreme-pressure additive.

* * * * *